United States Patent [19]

Friesen et al.

[11] 4,299,269

[45] Nov. 10, 1981

[54] HANDLING SYSTEM FOR FOUNDRY SAND MOLDS

[75] Inventors: Wilmer J. Friesen; Frank A. Hulet, both of Hutchinson, Kans.

[73] Assignee: Grede Foundries, Inc., Milwaukee, Wis.

[21] Appl. No.: 688,140

[22] Filed: May 20, 1976

[51] Int. Cl.[3] ..... B22D 33/00

[52] U.S. Cl. ..... 164/324; 164/323; 164/394

[58] Field of Search ..... 164/323, 324, 325, 339, 164/326, 322, 394; 198/477, 618, 793, 795, 800

[56] References Cited

U.S. PATENT DOCUMENTS

| | | | |
|---|---|---|---|
| 2,601,199 | 6/1952 | Zabel | 164/323 X |
| 3,703,921 | 11/1972 | Hunter | 164/130 |
| 3,789,914 | 2/1974 | Friesen et al. | 164/339 |
| 3,866,779 | 2/1975 | Dongelmans | 198/678 X |
| 3,955,613 | 5/1976 | Lund | 164/324 X |

FOREIGN PATENT DOCUMENTS

| | | | |
|---|---|---|---|
| 423287 | 12/1925 | Fed. Rep. of Germany | 164/324 |

*Primary Examiner*—Robert D. Baldwin

*Assistant Examiner*—Gus T. Hampilos

*Attorney, Agent, or Firm*—Andrus, Sceales, Starke & Sawall

[57] ABSTRACT

An intermittently moving gondola-type conveyor for handling pallet-supported foundry sand molds includes stations along the curvilinear path of said conveyor where (1) each freshly made mold is invested with a weighted jacket;

(2) each jacketed mold is moved to a position to receive molten metal;

(3) each of said metal-filled molds is moved through a cooling zone;

(4) at the end of said cooling zone, the weighted jacket is removed and transferred to an on-coming freshly made mold, and (5) said cooled metal casting and its surrounding unjacketed sand mold is subsequently discharged said conveyor; each gondola being movably suspended from an overhead curvilinear post-supported upper track, and stabilized against lateral swinging by movable attachments to a lower parallel track also supported by the vertical posts.

8 Claims, 12 Drawing Figures

HANDLING SYSTEM FOR FOUNDRY SAND MOLDS

BACKGROUND AND SUMMARY OF THE INVENTION

It is conventional for foundries to have automated conveyor systems which intermittently advance sand molds from a mold making station, through a cooling section of the conveyor, to a jacket and removal station, and through other operations stations until the metal casting is finally removed from the disintegrated sand mold. These systems involve the problem of removing the jacket and weight from each partly cooled mold and its solidified casting, and transporting to another portion of the conveyor and subsequently applying the jacket to a freshly formed green sand mold approaching the pouring station. Reference is made to U.S. Pat. Nos. 3,731,822 and 3,789,914, and U.S. application Ser. No. 475,493, filed June 3, 1974 and now abandoned, by inventors Wilmer J. Friesen and Frank A. Hulet.

The object of the present invention is to provide a chain of individually suspended mold-carrying gondolas which is intermittently moved around a closed curvilinear post-suspended track, each gondola being capable of carrying one or more sand molds on pallets, (also known as mold boards). In a preferred form of the invention, each gondola carries two molds, each on a separate pallet positioned end to end across the line of travel of the gondolas, the pallets resting on the gondola floors which are provided with slide members permitting the pallets to be movably positioned as to outer and inner locations.

A further object is to provide means laterally adjacent said chain of gondolas, for loading pallets holding fresh sand molds on to the gondolas, and for removing pallets with their cooled loads from the gondolas, at other locations along the circuit.

A still further object is to also provide means on each gondola for holding and vertically raising and lowering weighted jackets on to and off the sand molds positioned on the outer portion of the gondola floor, the said raising and lowering means being actuated by a trolley following a guide rail attached to the track-supporting posts at intermediate elevations.

These and other objects are attained by our invention which is further described below, reference being made to the accompanying drawings showing a preferred embodiment.

DESCRIPTION OF THE PREFERRED EMBODIMENT OF THE INVENTION

Figure 1:
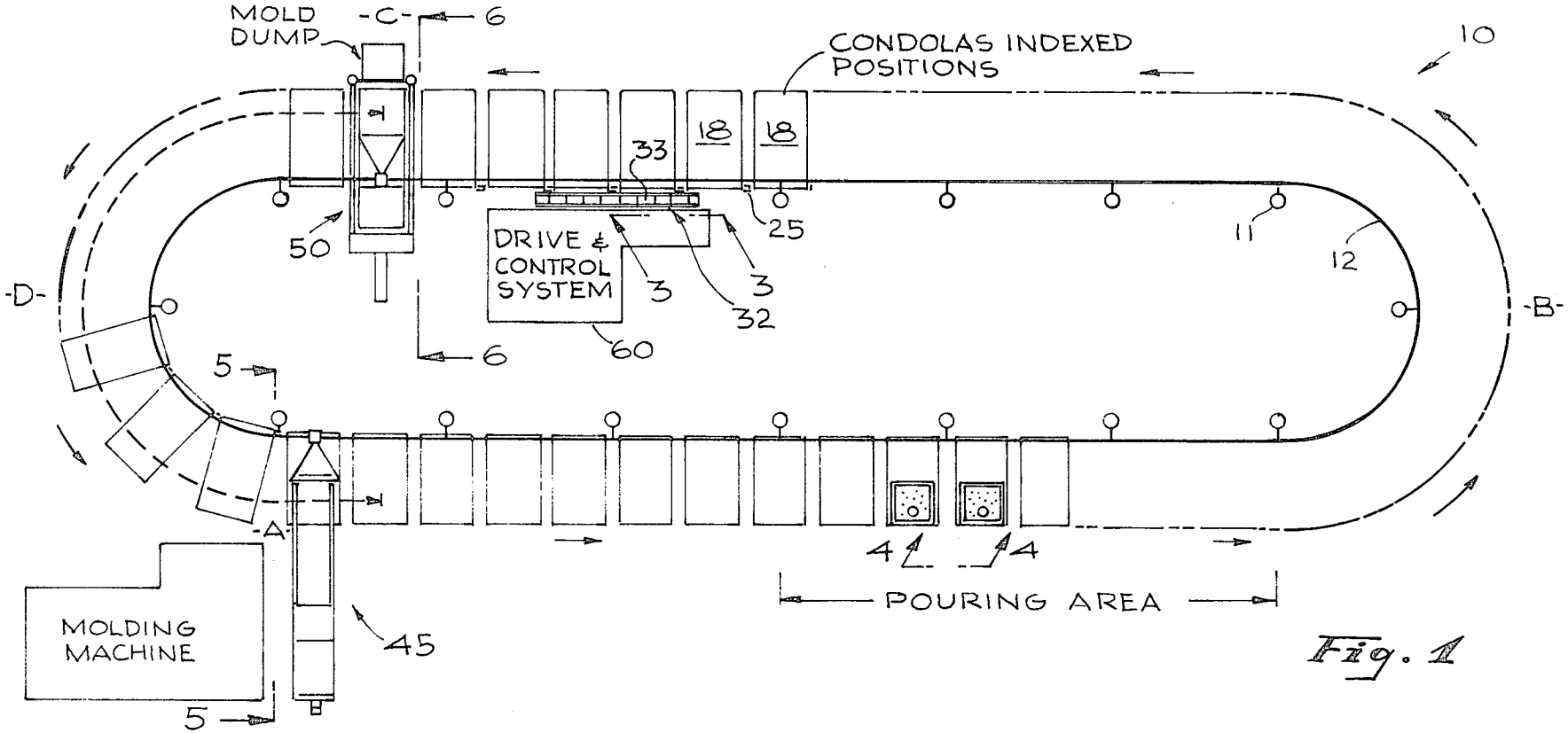
FIG. 1 is a diagrammatic plan view of the gondola conveyor system of this invention.
Figure 2:
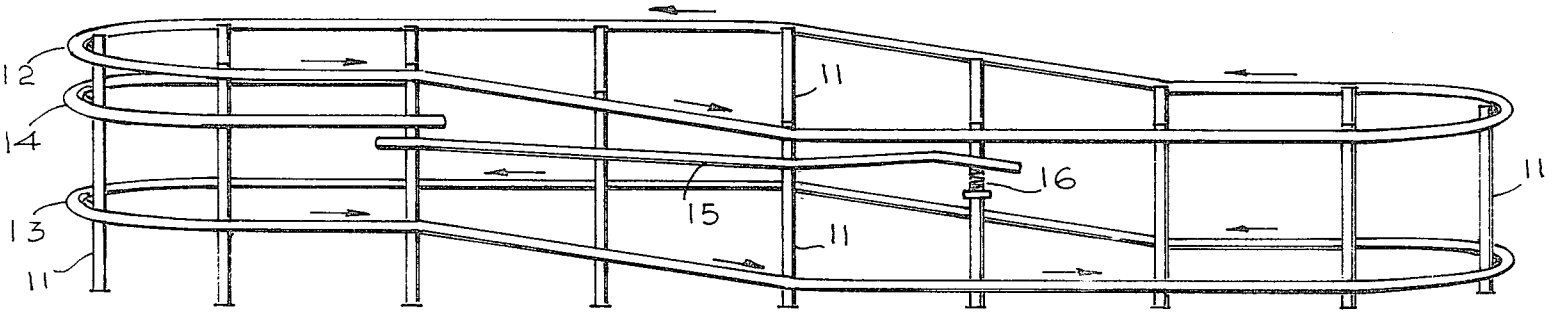
FIG. 2 is a side elevational view of the track system upon which the chain of gondolas is moved, including also guide tracks for actuating the lifting lever for vertically positioning the weighted jackets above, or on, the molds.

Referring to the drawings (which for clarity omit electrical wiring and piping to the several operating piston and cylinder assemblies) conveyor system 10 generally comprises a curvilinear track structure upon which a plurality of gondolas are movably mounted. The track structure consists of supporting posts 11, top rail 12, bottom rail 13 and intermediate guide rails 14 and 15 for actuating the jacket positioning mechanism. The top rail 12 is affixed to the top of each post 11, the actual elevation of the rail varying along its length to provide a lower elevation for the gondolas in the metal pouring area. The elevation of the lower rail conforms to or parallels that of the top rail.

Each gondola 18 consists of a rectangular bottom frame 19 having pallet-supporting slide members 20, a pair of arms 21 and 22 being fixed at their lower ends to the frame 19 and brought together at their upper ends, where they are attached to upper trolley blocks 23. Trolley blocks 24 are also attached to each bottom frame 19 on its inner side and are adapted to ride on the bottom rail 13 of the track structure.

Figure 4:
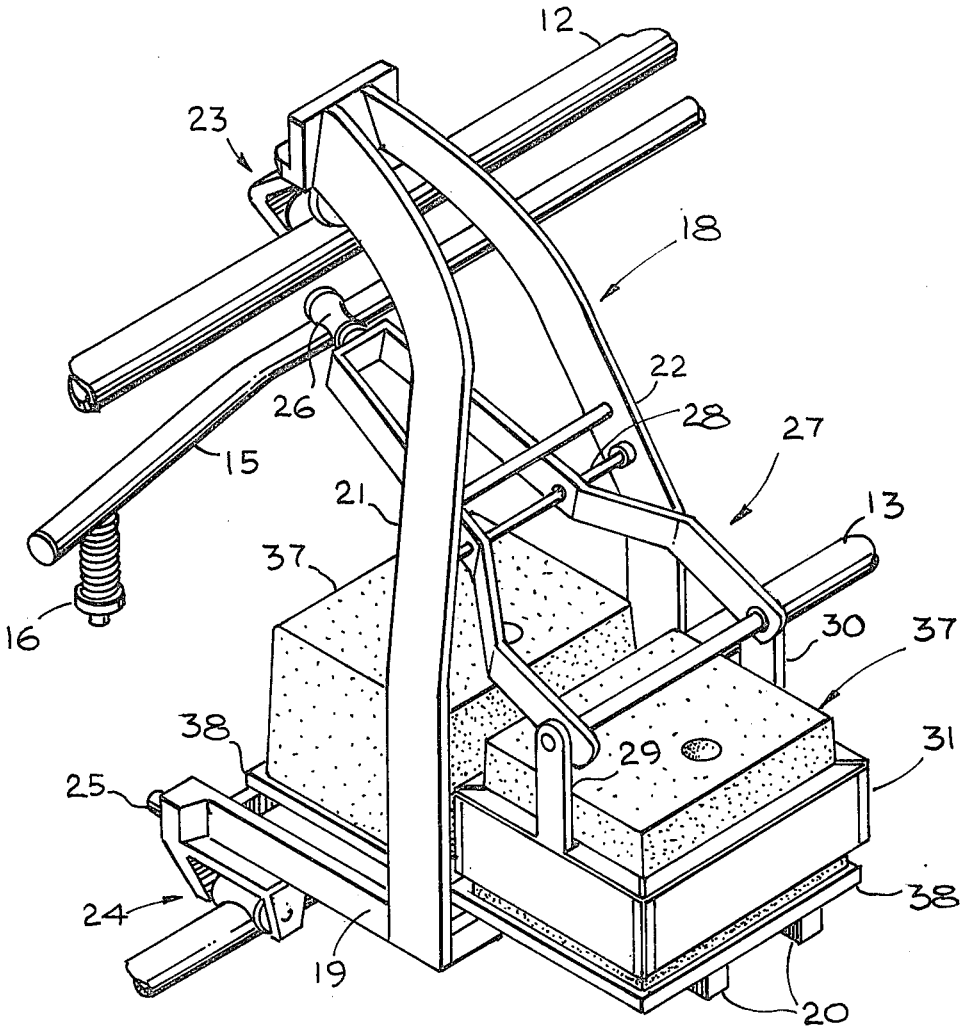
FIG. 4 is a front perspective view of a gondola carrying a sand mold, a weighted jacket being positioned on the mold at the down stroke of the shifting device which is pivotally attached to the gondola sides, and also showing the guiding rail which actuates the shifter.

The jacket-positioning mechanism for a mold carried on each gondola consists of lift frame 27 pivotally attached on a rod 28 held between the gondola arms 21 and 22, the frame being also pivotally attached to a pair of upright arms 29 and 30 rigidly fixed to the jacket 31. The roller 26 on the opposite end of the lift frame 27 from the mold jacket 31 is engageable above the guide rail 15 as generally shown in FIG. 4 to effect a lowering of the jacket to embrace and support the outwardly disposed sand mold 37 as each gondola 18 advances along the track structure. The jacket 31 is in the lowermost position prior to reaching the metal pouring area indicated on FIG. 1, and the compression spring 16 beneath the end of the guide rail 15 in the direction of movement of the gondolas 18 serves to set the respective jackets onto the corresponding outer molds 37 with a given pressure.

Figure 5A:
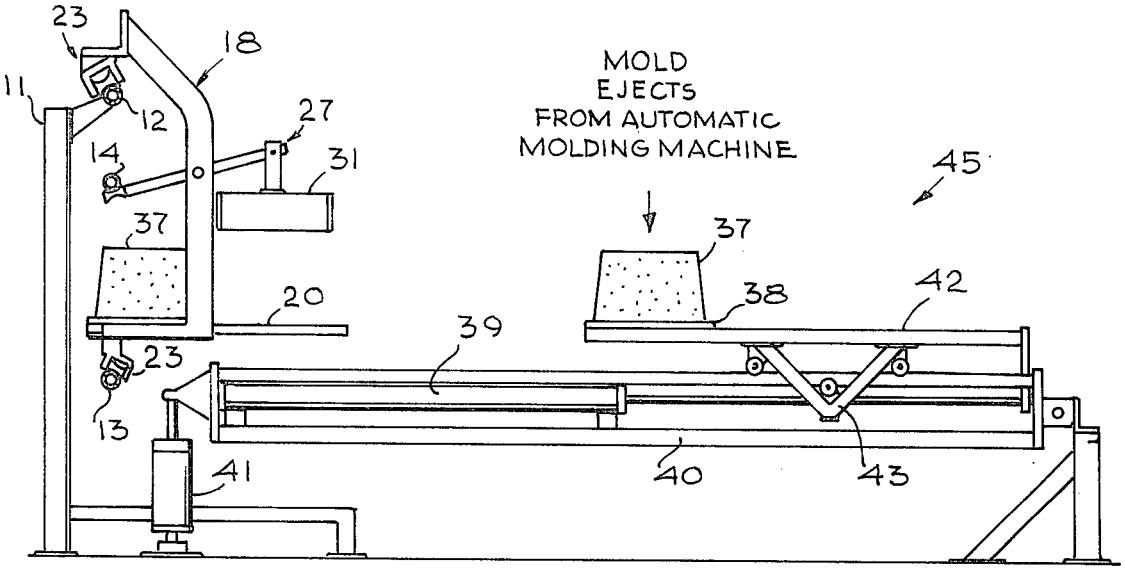
FIG. 5A is a side elevational view from the 5—5 position indicated in FIG. 1, of a mold loader at the start of delivery of a green sand mold to the gondola.
Figure 5B:
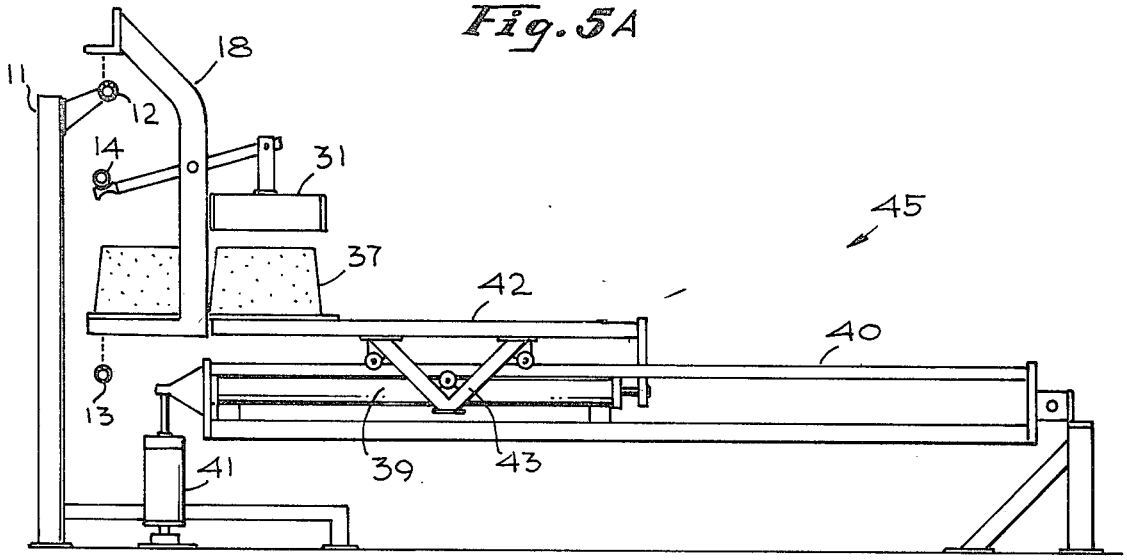
FIG. 5B is a side elevational view as in FIG. 5A, after the mold has been placed on the gondola.
Figure 5C:
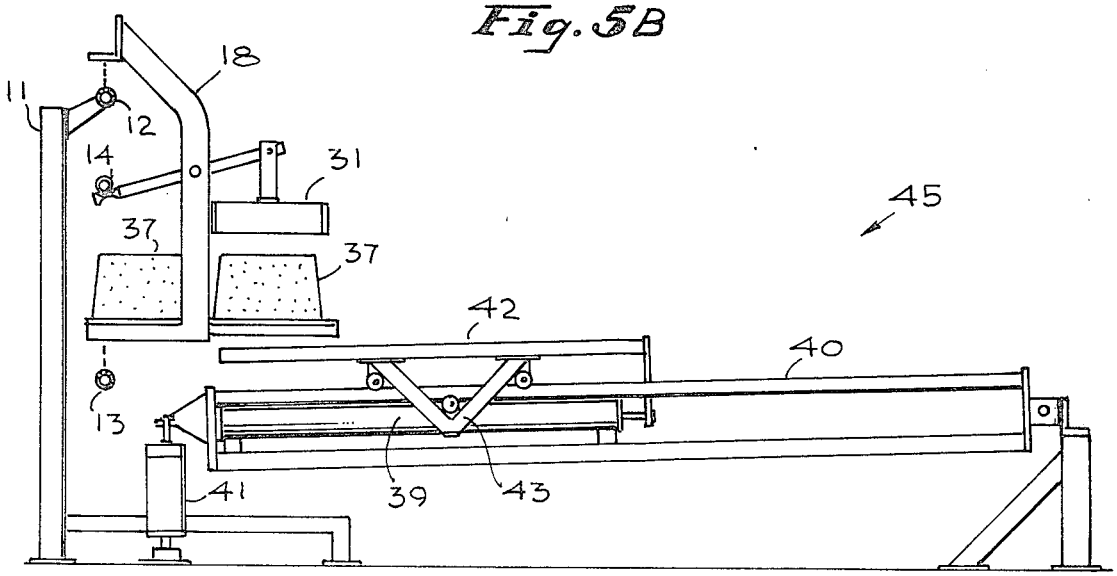
FIG. 5C is a side elevational view as in FIG. 5B, with the mold loader at its lowest elevation.

The roller 26 engages beneath the guide rail 14 to lift the mold jacket 31 to a position spaced above the outer mold 37 prior to the corresponding gondola 18 reaching the mold dump station as generally shown in FIGS. 6A through 6E. The guide rail 14 maintains the jacket 31 in the raised position through the mold loading station as generally shown in FIGS. 5A through 5C.

The gondola conveyor system may be operated in different ways depending upon the manner in which the several necessary functional manipulations of the molds are carried out. The chain of gondolas is moved as a unit, in step-by-step progression around the curvilinear track, the unit traverse step being the width of one gondola and the time interval of rest of the chain being fixed by the time required to perform all the motions of loading or of unloading, or the speed of the mold-making machine, whichever is longest.

Figure 3:
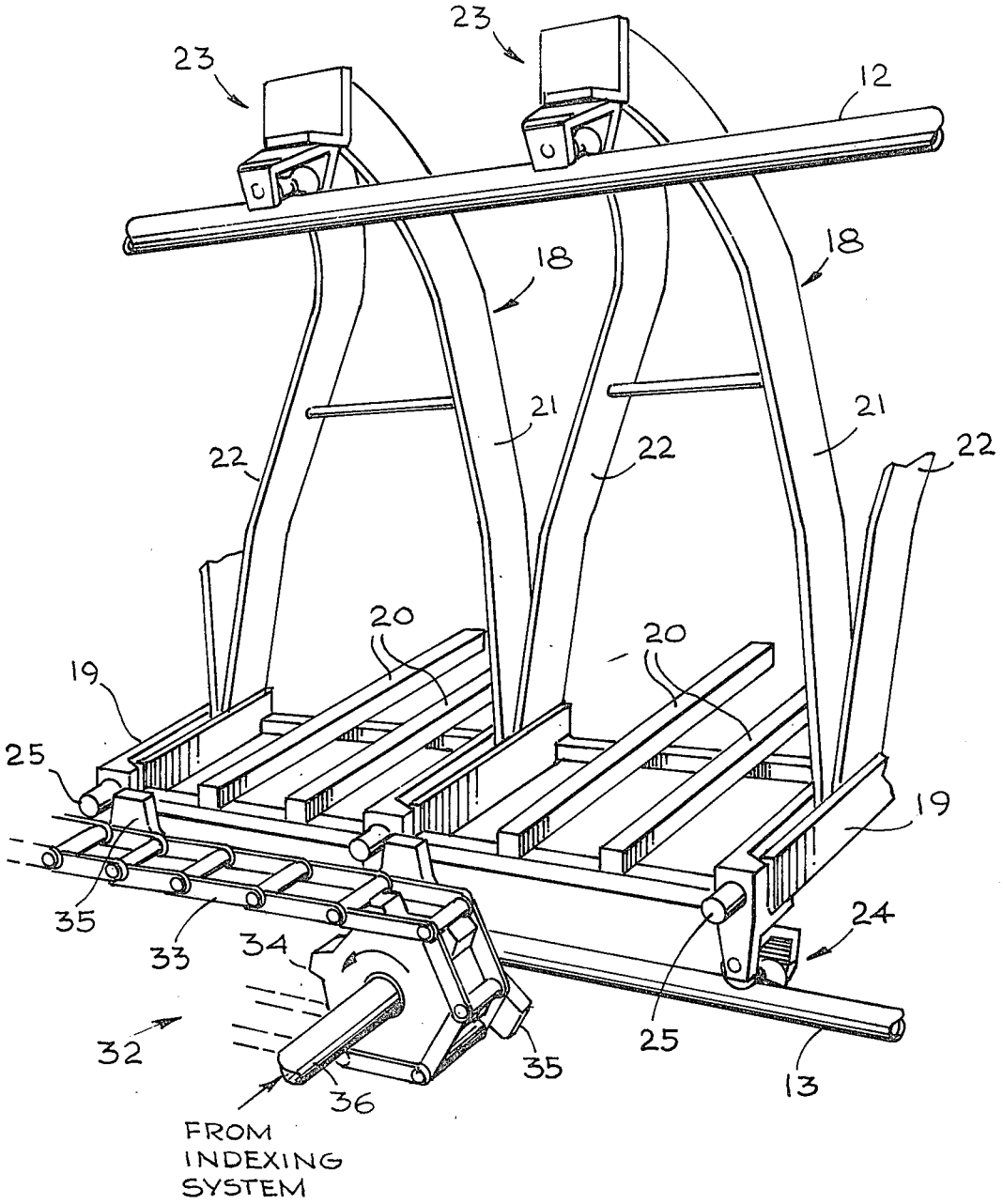
FIG. 3 is a fragmentary view of a portion of the gondola conveyor system showing side-by-side gondolas as supported on fragments of the upper and lower supporting rails, the shifter mechanism being omitted for clarity.

The preferred drive for the gondola chain includes an electric motor driving a variable ratio belt reducer, connected through an air operated clutch to a single reduction gear reducer, with a shaft mounted sprocket and hardened conveyor chain. The driven shaft and sprocket are on a commercial take-up assembly. The drive system 32 is indicated diagrammatically on FIG. 1, but the drive chain 33 and the sprocket 34 and the driving lugs 35 for engaging each gondola 18 are shown in part in FIG. 3.

The conveyor path as shown in FIG. 1 is divided into a loading zone A, a pouring and cooling zone B, a mold dumping zone C and a transition zone D, the disposition of the molds on all of the gondolas in each of the pertaining zones being the same.

A loader 45 at zone A for loading green sand molds on to the gondola conveyor system is shown in FIGS. 5A through 5C. Green sand molds are ejected from a molding machine and delivered on to a pallet or mold board 38, and then transferred to a gondola floor properly positioned on the traverse path uring the non-movement period of the gondola chain. In FIG. 5A there is shown the green sand mold 37 on its pallet 38 as ejected from the molding machine onto the carrier 42 of a tilt table 40. The carrier 42 is longitudinally movable toward the gondola slide members 20 by operation of the air cylinder and piston 39 connected to the table by the frame projection 43. The tilt table 40 may be raised on its forward end by means of a vertically disposed air cylinder and piston combination 41 so that the mold board and mold are properly disposed on the supporting slide members 20. The carrier 42 is then withdrawn to its beginning position, ready to receive the next pallet carrying its sand mold, as shown in FIG. 5A. The jacket positioning mechanism or lift frame 27 on the gondola is in the off position during the mold loading operation as generally shown in FIGS. 5A through 5C.

Figure 6A:
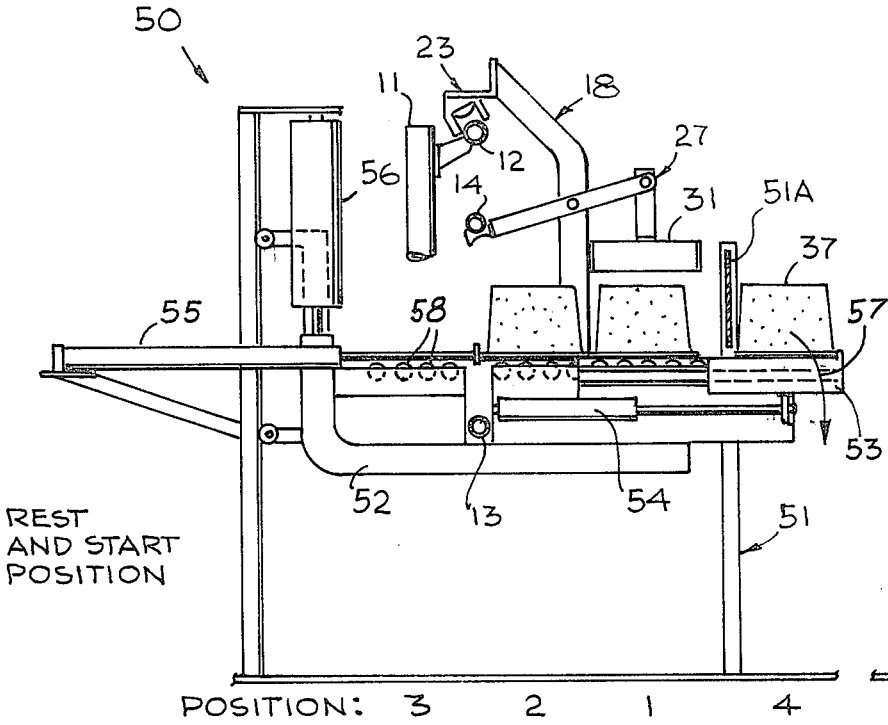
FIG. 6A is a side elevational view of a gondola adjacent the mold dumping device with its carriage in "up" position and at the rest and start position of the dumping action.
Figure 6B:
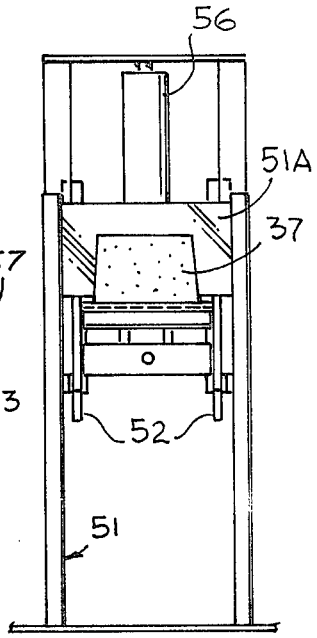
FIG. 6B is an end elevational view of the dumping device, as in FIG. 6A.
Figure 6C:
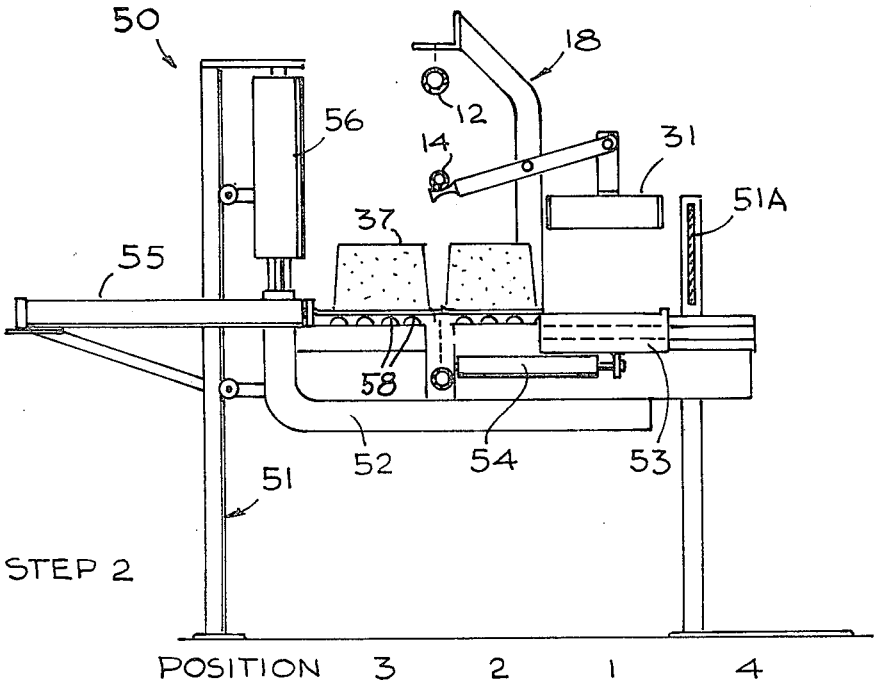
FIG. 6C is a side elevational view of the gondola and the mold dumping device at Step 2, with the mold to be dumped in the position 3.
Figure 6D:
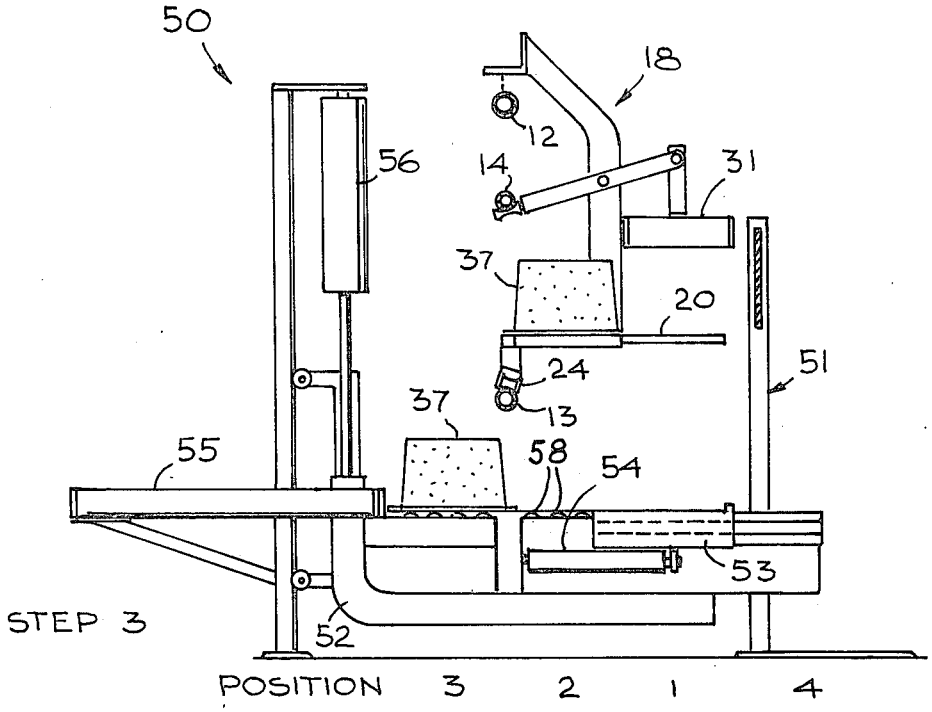
FIG. 6D is a side elevational view, showing the dumping device at its lowest position, at Step 3, the mold to be dumped at position 3.
Figure 6E:
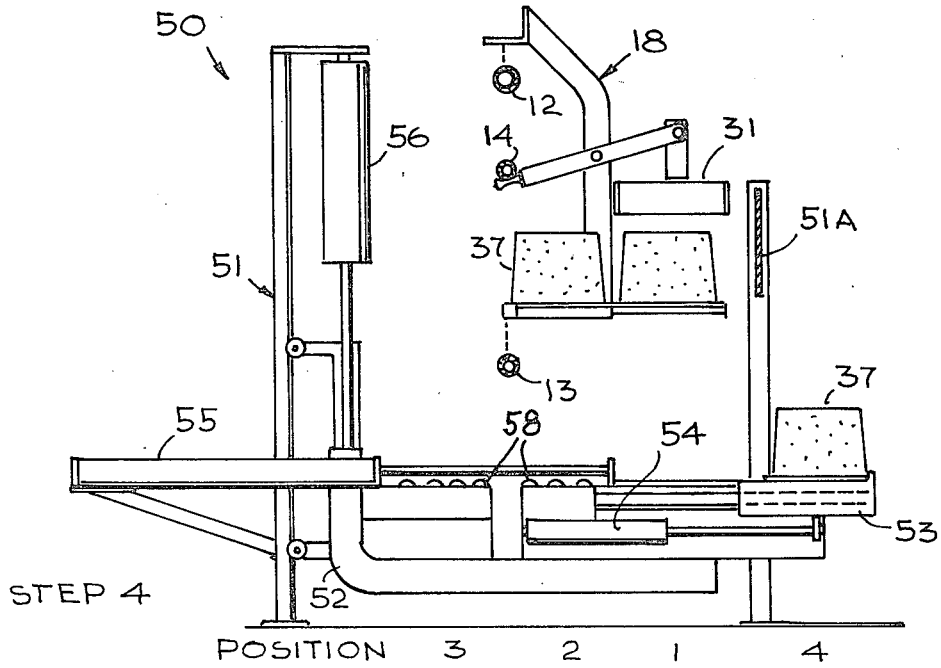
FIG. 6E is a side elevational view as in FIG. 6D, with the mold to be dumped at position 4 and with the next succeeding gondola indexed to the mold dumping station.

A mold dump mechanism 50 for discharging a cooled sand mold 37 and its contained metal casting is shown in FIG. 6A through 6E, being disposed across the path of movement of the chain of gondolas as indicated at zone C on FIG. 1. The several steps of the mold dumping operation are shown in FIGS. 6C, 6D, and 6E. The mold dump movements are effected by air cylinder-piston assemblies 54, 55 and 56 of the proper sizes.

In the stopped interval of the conveyor at Zone C, the horizontally moveable mold dump carrier 53 supports a mold ready to be dumped off its bottom board, as generally indicated by the direction arrow 57 in FIG. 6A. The mold dump carrier 53 is in turn mounted on the vertically movable carrier 52 which in the uppermost dump position generally shown in FIG. 6A raises the molds 37 up from the gondola slides 20 onto the bed of rollers 58 on the carrier 52.

After the vertically movable carrier 52 reaches its uppermost position, the mold 37 on the carrier 53 is scraped off by stroking its bottom board under a fixed scraper plate 51A (Fixed scraper plate is attached to the vertical posts 51 by movement of the carrier 53 by operation of the cylinder-piston assembly 54 to the position shown in FIG. 6C. This scrapes or pushes mold 37 on the carrier 53 off the bottom board into the shake-out conveyor system, not shown. As the mold board 38 on carrier 38 moves inwardly with the carrier 53 beyond the scraper plate 51A, it engages the mold board of the outer mold on the gondola 18 and forces the two molds on the gondola inwardly, with the inner of the two molds being displaced inwardly on the mold dump carrier 52 for dumping on the next cycle of the mold dump mechanism 50 and the outer of the two molds being displaced to the inner position on the gondola for additional travel on of the conveyor system 10 to provide for further cooling of the casting before it too is removed from the conveyor system.

The carrier 53 is then moved downwardly by operation of the cylinder-piston assembly 56 as generally shown in FIG. 6D, ceasing interference with the gondolas, so that they may be indexed forward one gondola. During the gondola indexing, the mold on the bed of rollers 58 of the lowered carrier 52 is transferred under the gondolas by operation of the cylinder-piston assembly 55 from the innermost position on the rollers 58 to the outermost position on the carrier 53 as generally shown in FIG. 6E.

With the gondolas completed indexing, and the mold in its outermost position, the carrier 52 again moves upward until it is supporting the two molds on the next succeeding gondola, plus the outermost mold on the carrier 53. The dump has completed one cycle.

We claim:

1. In a conveyor system for foundry sand molds; a curvilinear track means defining a closed path having a mold loading station, a metal casting station and a mold unloading station; a plurality of mold carriers supported for movement along the track means; each of said mold carriers being adapted to carry a plurality of sand molds arranged in a line thereon generally normal to the path of travel along the track means with the mold position at one end of the line being the loading position and the mold position at the opposite end of the line being the unloading position; drive means for effecting intermittent movement of the mold carriers between indexed positions along the track means; means at the mold loading station for loading a sand mold onto the loading position of the respective mold carriers; a mold jacket provided on each mold carrier to embrace and support the newly added sand mold during the metal casting procedure; lever means pivotally carried by each mold carrier on an axis generally paralleling the track means and in turn pivotally carrying the mold jacket adjacent to one end thereof; a first guide rail mounted on the track means; a follower carried adjacent to the opposite end of the lever means from the mold jacket and being engageable on the first guide rail to effect a pivoting of the lever means to thereby lower the mold jackets to embrace the corresponding said molds in the loading position prior to the respective mold carriers reaching the metal casting station; a second guide rail mounted on the track means; said follower on the lever means being engageable under the second guide rail to pivot the lever means and thereby lift the respective mold jackets from the sand molds to a position spaced above the sand molds prior to the respective mold carriers reaching the mold unloading station; and means at the mold unloading station for removing the sand mold in the unloading position from the respective mold carriers and moving the balance of the sand molds on the carriers toward the unloading position for further cooling of the cast metal in the latter molds during additional travel along the track means prior to their unloading and to vacate the loading position on the mold carriers in readiness for the reception of another sand mold.

2. The structure as set forth in claim 1 wherein the means at the mold loading station for loading a sand mold onto the loading position of the respective carriers is outside of the track means, and the loading position on the respective carriers is the mold position disposed outwardly relative to the track means.

3. The structure as set forth in claim 2 wherein the unloading position on the respective carriers is the mold position disposed inwardly relative to the track means.

4. The structure as set forth in claim 1 wherein the respective mold carriers carry a pair of sand molds with the mold position disposed outwardly relative to the track means being the loading position and the mold position disposed inwardly relative to the track means being the unloading position.

5. The structure as set forth in claim 1 wherein the track means is supported by a plurality of vertical posts in spaced relation above the floor.

6. The structure as set forth in claim 5 wherein the track means comprises a pair of vertically spaced, generally parallel tracks.

7. The structure as set forth in claim 6 wherein the spaced tracks are engageable by spaced trolley blocks on the mold carriers.

8. The structure as set forth in claim 1 wherein spring means bias the first guide rail and lever means upwardly to lower the mold jackets onto the corresponding sand molds with a given pressure.

* * * * *

UNITED STATES PATENT AND TRADEMARK OFFICE

CERTIFICATE OF CORRECTION

PATENT NO. : 4,299,269

DATED : November 10, 1981

INVENTOR(S) : Wilmer J. Friesen et al.

It is certified that error appears in the above-identified patent and that said Letters Patent are hereby corrected as shown below:

On The Title Page,
Abstract, Line 15, After "discharged" insert ----from----.

Column 2, Line 31 After "assemblies)" insert ----the----.

Column 3, Line 37 After "path" delete "uring" and substitute therefor ----during----.

Column 4, Line 6 After "51A" delete "(Fixed scraper plate is"

Column 4, Line 12 After "carrier" delete "38" and substitute therefor ----53----.

Column 4, Line 64 After "corresponding" delete "said" and substitute therefor ----sand----.

Signed and Sealed this

Sixth Day of July 1982

[SEAL]

Attest:

GERALD J. MOSSINGHOFF

Attesting Officer

Commissioner of Patents and Trademarks